US010766116B2

(12) United States Patent
Kellogg

(10) Patent No.: US 10,766,116 B2
(45) Date of Patent: Sep. 8, 2020

(54) HAND-HELD SANDING DEVICE WITH CONTINUOUS ROTATING BELT

(71) Applicant: David D. Kellogg, San Jose, CA (US)

(72) Inventor: David D. Kellogg, San Jose, CA (US)

( * ) Notice: Subject to any disclaimer, the term of this patent is extended or adjusted under 35 U.S.C. 154(b) by 0 days.

(21) Appl. No.: 15/229,304

(22) Filed: Aug. 5, 2016

(65) Prior Publication Data

US 2018/0036858 A1 Feb. 8, 2018

(51) Int. Cl.
*B24B 23/06* (2006.01)
*B24B 21/20* (2006.01)
*B24D 15/04* (2006.01)

(52) U.S. Cl.
CPC ..... *B24B 23/06* (2013.01); *B24B 21/20* (2013.01); *B24D 15/04* (2013.01)

(58) Field of Classification Search
CPC ..... B24B 23/06; B24B 23/02; B24B 21/20; B24B 21/18
USPC ..... 451/355, 344, 297, 311, 296
See application file for complete search history.

(56) References Cited

U.S. PATENT DOCUMENTS 1,837,352 A 12/1931 Willcox
2,447,327 A 8/1948 Gerrits et al.
4,478,011 A * 10/1984 Russell ..... B24D 15/026 451/492
4,730,430 A 3/1988 Petrovich
5,007,205 A * 4/1991 Farmerie ..... B24B 21/20 451/355
5,177,909 A 1/1993 Klocke
6,755,727 B1 * 6/2004 Bjerkhoel ..... B24B 21/04 451/495
6,951,297 B1 * 10/2005 Lopez ..... B24D 15/026 225/22
7,083,508 B2 * 8/2006 Swaddle ..... B24B 23/06 451/344
7,201,646 B1 4/2007 Patton
7,837,537 B2 * 11/2010 Wall ..... B24B 23/06 451/296
2010/0261414 A1 * 10/2010 Fronek ..... B24B 23/04 451/28

* cited by examiner

*Primary Examiner* — George B Nguyen

(74) *Attorney, Agent, or Firm* — Wood Herron & Evans LLP

(57) ABSTRACT

A hand-held sanding device for sanding a work piece. The sanding device includes a frame adapted for a manual grip and a sanding material provided within the frame for movement relative to the frame. The sanding material forms a sanding surface for the device. The sanding material moves relative to the frame through contact between the sanding surface and the work piece.

24 Claims, 18 Drawing Sheets

HAND-HELD SANDING DEVICE WITH CONTINUOUS ROTATING BELT

FIELD OF THE INVENTION

The present invention relates to abrading tools and, more particularly, to a hand-held sanding device having a rotating sanding belt.

BACKGROUND OF THE INVENTION

When conducting woodworking and related crafts requiring a finished surface, a woodworker will oftentimes manually rub the surface of a work piece using a sheet of abrasive material, such as sand paper, to even out and smooth the surface. This can be a slow process, made more difficult because a sheet of sand paper can quickly wear out, and holding onto the paper while manually rubbing the piece can cause hand strain. Sanding blocks offer some improvement to sand paper. The blocks can be ergonomically shaped, and can hold larger pieces or sheets of sand paper. Additionally, sanding blocks include apparatus for holding the paper in place on the block.

Sanding blocks, however, also have several drawbacks. For instance, the paper on the sanding block tends to gum up or fill because the same area of the block is being repeatedly rubbed against the work piece. Stopping and cleaning the sand paper requires extra time, which is frustrating and inefficient. Additionally, the sand paper can easily rip because of the repeated wear in the same location. The sand paper also can easily rip if the paper is not held perfectly tight on the block. Having loose paper on the sanding block can also reduce the quality of the sanding done with the block and, thus, the quality of the finished work product.

Automatic sanders, either belt-type or orbital-type, can be easier to use, but they often provide more force than is necessary for the project, and can have a number of drawbacks. In particular, automatic sanders require a power source, necessitating the inconvenience of a power cord or the added weight of batteries. Automatic belt-type sanders also have the reputation of removing too much material too quickly. Orbital sanders are more commonly used, but can generate a lot of dust and also be too aggressive in removing material from the work piece. With fine woodworking, better results are typically achieved if the sanding is accomplished by hand, because hand sanding allows a much lighter touch than a motorized machine.

Accordingly, to facilitate fine woodworking, it is desirable to have a hand-held sanding device which is easy to use, and which eliminates the hand strain associated with sand paper. Additionally, it is desirable to have a hand-held sanding device which distributes the contact between the work piece and sanding material across a large surface area of the material, to prevent uneven wear, gumming up, or ripping of the material. Further, it is desirable to have a hand-held sanding device which holds the sanding material tightly on the device. Furthermore, it is desirable to have a hand sanding device which allows for easy removal and replacement of the sanding material, and which can operate without a secondary power source.

SUMMARY OF THE INVENTION

The present invention addresses the shortcomings of the prior art by providing a hand sanding device in accordance with several different aspects. According to a first aspect, the present invention provides a hand-held sanding device for sanding a work piece. The sanding device includes a frame adapted for a manual grip and a sanding material provided within the frame for movement relative to the frame. The sanding material forms a sanding surface for the device. The sanding material moves relative to the frame through contact between the sanding surface and the work piece.

In a second aspect, the invention features a hand-held sanding device having a frame and a plurality of rollers mounted within the frame. A sanding belt is trained over the rollers to rotate continuously with the rollers during a sanding operation. A tensioning member is provided for maintaining tension in the sanding belt as the belt rotates about the rollers. The tensioned belt forms a planar sanding surface for the device.

The above and other objects and advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
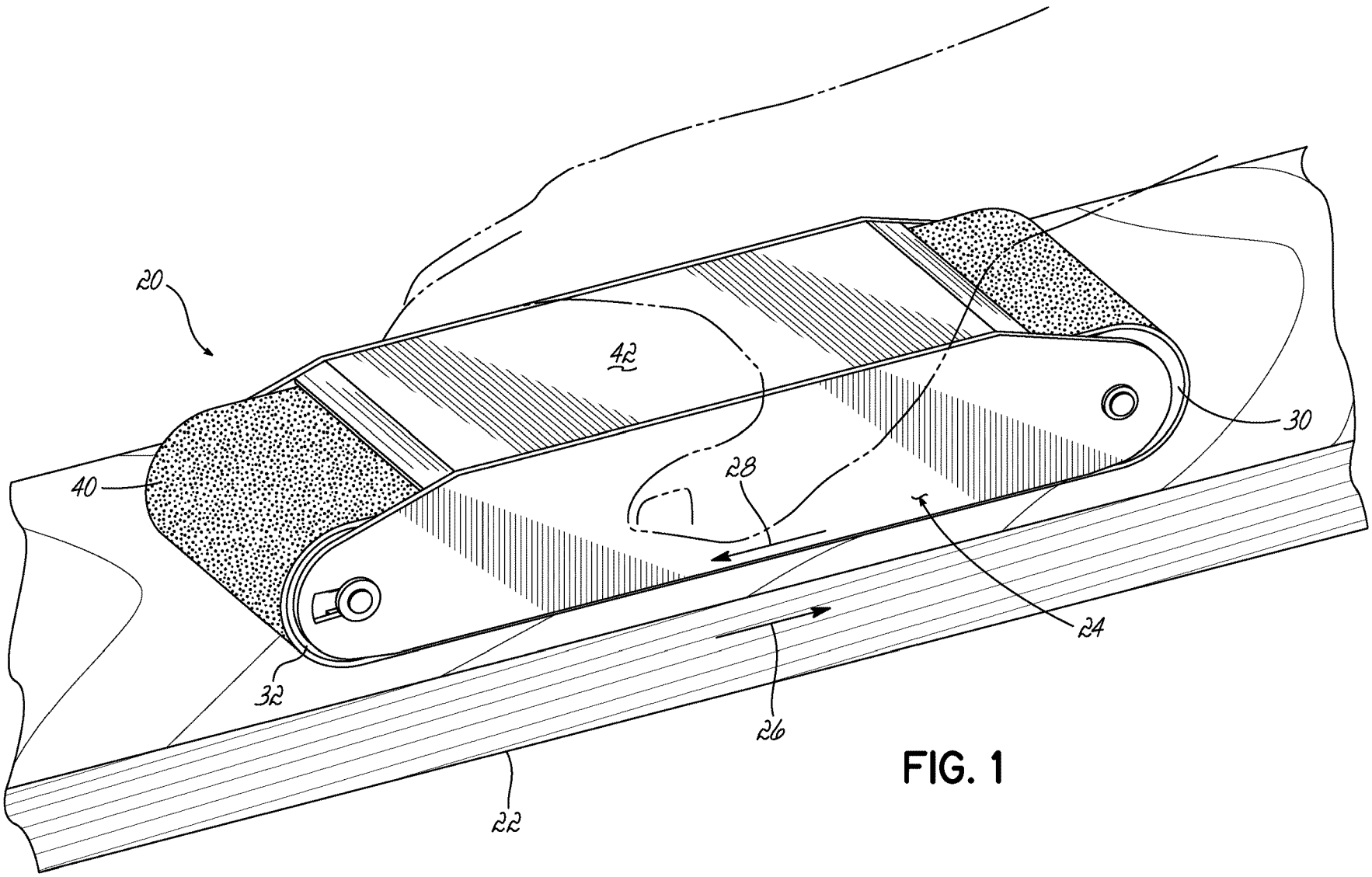
FIG. 1 is a perspective view of an exemplary embodiment of a hand-held sanding device of the invention.

Referring now to the drawing figures, wherein like numerals indicate like elements throughout the views, FIG. 1 illustrates a first exemplary embodiment of an abrading or sanding device 20. As shown in FIG. 1, device 20 can be used to manually rub or scrape the surface of a work piece 22 to wear away roughness and smooth the piece. Sanding device 20 includes a frame 24 with rollers 30, 32 mounted at opposite ends. An abrasive material is provided within frame 24 for contact with the work piece. This material can be composed of any type of abrasive substance including, for example, sand, pumice, emery, etc., which produces friction when rubbed against an object in order to scrape or remove portions of the surface. In the embodiments described herein, the abrasive material is shaped into a continuous loop or belt 40. Belt 40 is removably mounted on rollers 30, 32, to rotate in conjunction with the rollers, as device 20 is drawn along the surface of a work piece 22.

Belt 40 can vary in width, from approximately 1 inch to greater than 6 inches. Device 20 can be sized to accommodate standard belt widths such as, for example, 3 or 4 inches, to enable the device to be used with commercially available, "off the shelf" sanding belts. Additionally, the device frame 24 can be designed to be approximately the same width as the sanding belt, to enable the device to be used to sand into corners or up against raised edges. Rollers 30, 32 are biased outward within frame 24, as will be described below, to hold belt 40 in a taut or tensioned condition between the rollers. The tensioned belt forms a planar sanding surface along the length of the device. A cover 42 is provided on frame 24 on the opposite side of the sanding surface, to form a hand grip above the belt 40. As device 20 is drawn in a longitudinal direction along the work piece 22, as indicated by arrow 26, the contact between the belt 40 and the work piece 22 rotates the belt in the opposite direction, as indicated by arrow 28.

Figure 2:
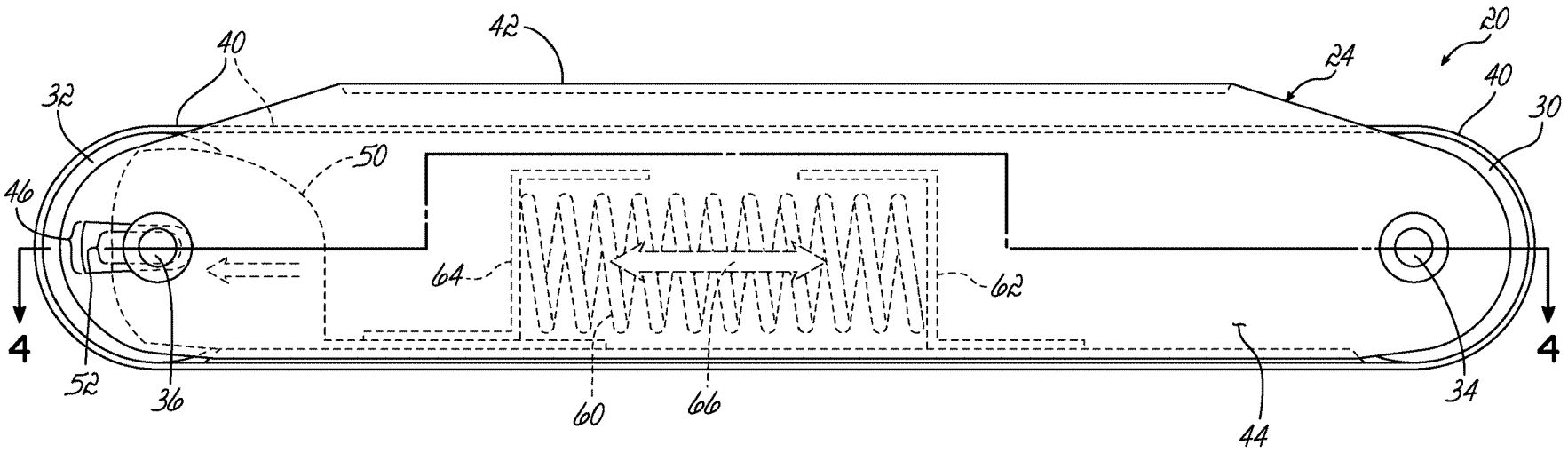
FIG. 2 is a side view of the device of FIG. 1.
Figure 3:
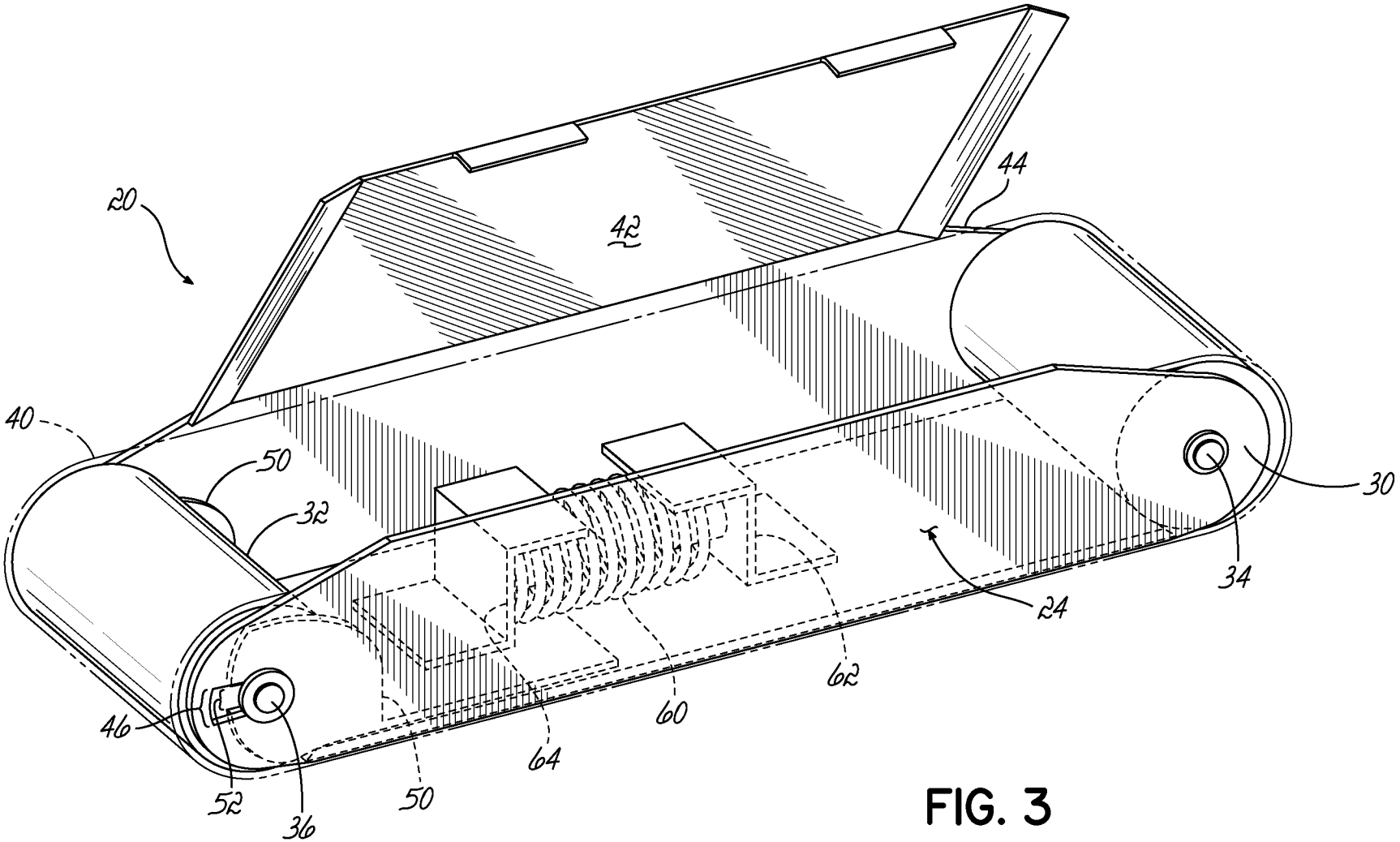
FIG. 3 is a perspective view of the device of FIG. 1, shown with the cover open and the sanding belt in phantom.
Figure 4:
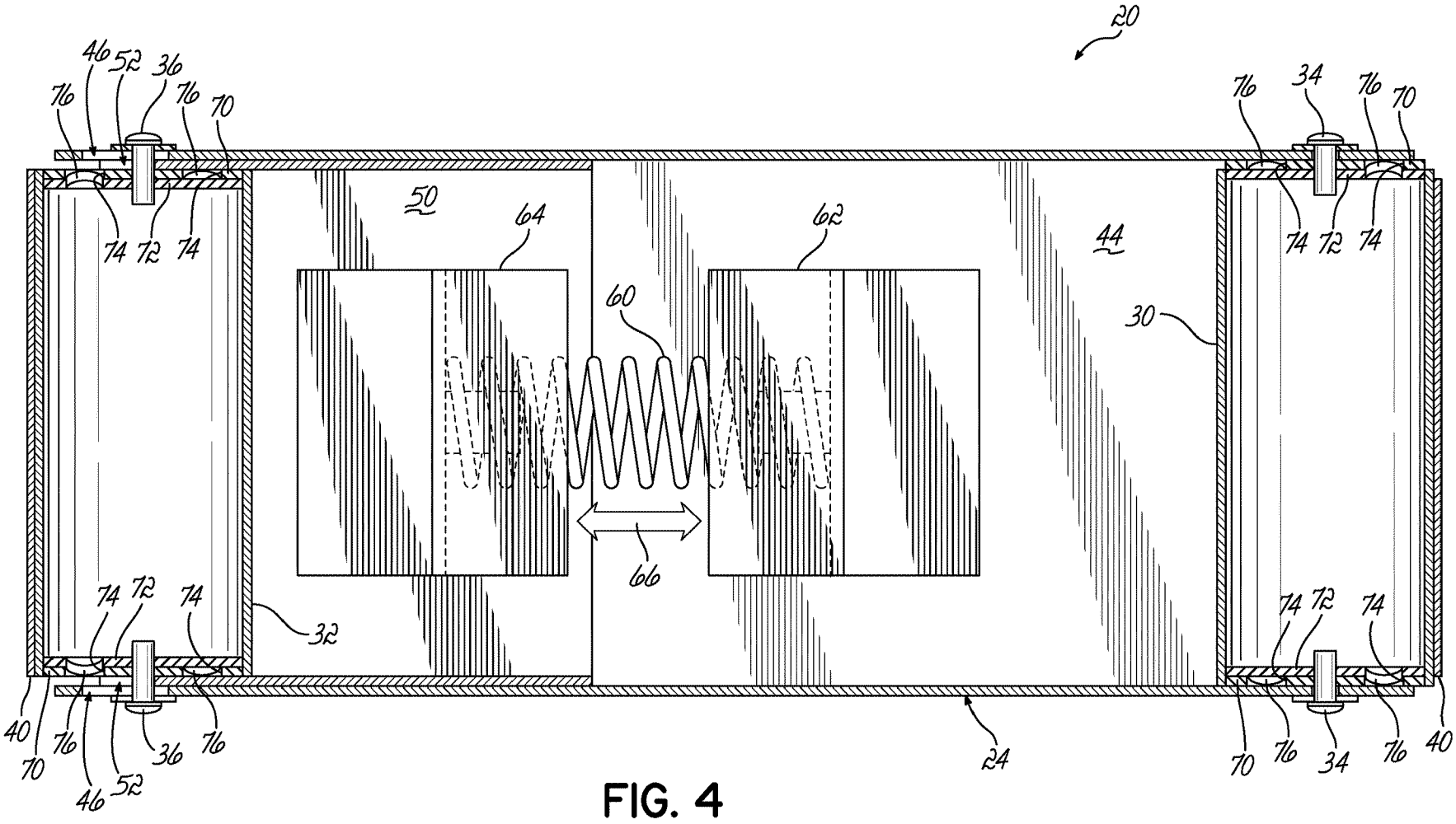
FIG. 4 is a top, cross-sectional view of the device of FIG. 1, taken along line 4-4 in FIG. 2.

As shown in FIGS. 2-4, device frame 24 of device 20 includes first and second sections 44, 50 that slide relative to each other. The frame sections each include a planar base, and side members extending in a perpendicular direction from opposite sides of the base. A first one of the rollers 30 is attached to one end of first frame section 44 by pins 34 extending out along the rotational axis of the roller. Pins 34 attach roller 30 between the side members of frame section 44, to fix the roller position relative to the frame section, while allowing the roller to rotate within the frame. The second end of frame section 44 has longitudinally extending slots 46 formed therein. Slots 46 slidingly engage rotational axis pins 36 extending out along the rotational axis of the second roller 32. The second frame section 50 also includes a pair of longitudinally extending slots 52 in the side members. Slots 46, 52 receive roller axis pins 36 to mount second roller 32 to the frame 24. The mounting of pins 36 within slots 46, 52 enables roller 32 to rotate within the frame 24, while also being moveable in a direction perpendicular to the rotational axis. Cover 42 is positioned over belt 40 on the side opposite the planar sanding surface. In the embodiment shown in FIGS. 2-4, the cover 42 is pivotally attached to a side of first frame section 44. The cover is attached to an upper edge of the frame to pivot way from the belt 40 when opened, to allow access to the belt beneath. When pivoted closed, cover 42 extends over the belt 40 to provide a hand rest or grip above the rotating belt.

A tensioning member is mounted in frame 24 between rollers 30, 32, for permitting movement of the frame sections 44, 50 relative to each other, while outwardly biasing the rollers in a spaced relationship. In the exemplary embodiment shown, the tensioning member is a resilient spring 60. Spring 60 is mounted in frame 24 between first and second brackets 62, 64, which extend vertically from the base of frame sections 44, 50. First bracket 62 is attached to the first frame section 44, and second bracket 64 is attached to the second frame section 50. Spring 60 is mounted, in tension, between the inward facing, vertical extension of each bracket. The tension in spring 60 biases the brackets 62, 64 and, correspondingly, the attached frame sections 44, 50 apart, as shown by arrow 66 in FIGS. 2 and 4. The force of spring 60 drives the rollers 30, 32 outward, and pulls the belt 40 taut about the rollers. As roller 32 is biased outward by spring 60, pin 36 slides to an inward-most position in slots 46, 52, as shown in FIGS. 2 and 3. The spacing between rollers 30, 32 can be adjustable, by a screw or other mechanism, so that the tension or slack in the sanding belt can be set to the user's preference. In the tensioned condition, belt 40 may be pulled along the surface of a work piece to perform a sanding task. As belt 40 is pulled along the work piece, the frictional contact between the belt and work piece creates a secondary pulling force on the belt causing the belt and, in turn, rollers 30, 32 to rotate. As the belt 40 rotates, the area of the belt in contact with the work piece 22 continually changes.

To remove sanding belt 40 from the device, cover 42 is pivoted open to expose the belt. Opposing forces are applied to rollers 30, 32 to push the rollers inward towards each other. The opposing forces can be applied by positioning a hand over each of the rollers and pushing inward. The opposing, inward force on rollers 30, 32 compresses spring 60. The inward force on rollers 30, 32 slides pins 36 within slots 46, 52 as the spacing between the rollers decreases. As rollers 30, 32 move inward the tension in belt 40 is relaxed, allowing the belt to be pulled or slid off of the rollers. A replacement belt can be positioned over rollers 30, 32, and the inward force on the rollers released, to allow spring 60 to return the rollers to an outwardly-biased position, with the belt 40 held taut between the rollers. As spring 60 moves rollers 30, 32 outward, roller pins 36 move to an inner-most position in frame slots 46, 52.

To facilitate a belt change, a latching mechanism can be included in frame 24 for holding rollers 30, 32 and spring 60 in an inward, compressed position, while the used belt is removed from the rollers and a replacement belt mounted over the rollers. The latching mechanism can be automatic, with the latch being set when rollers 30, 32 are first compressed together, and released with a second compression of the rollers to move the rollers outward and return the belt 40 to full tension. A number of different types of latching mechanisms may be used to hold the rollers in a compressed position including a cam mechanism, a catch mechanism or a roller catch, for example.

Figure 6:
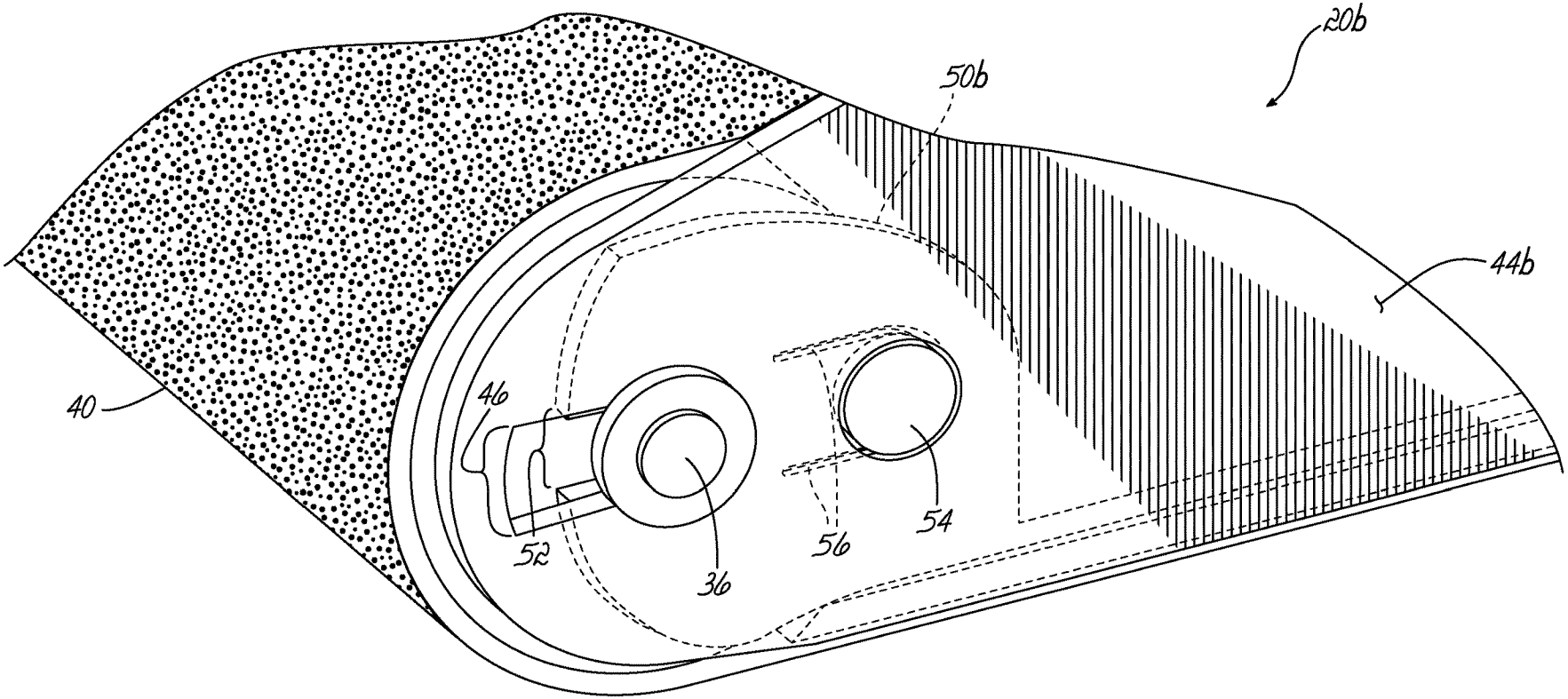
FIG. 6 is a partial, perspective view of a roller end showing a first exemplary latching assembly.
Figure 7A:
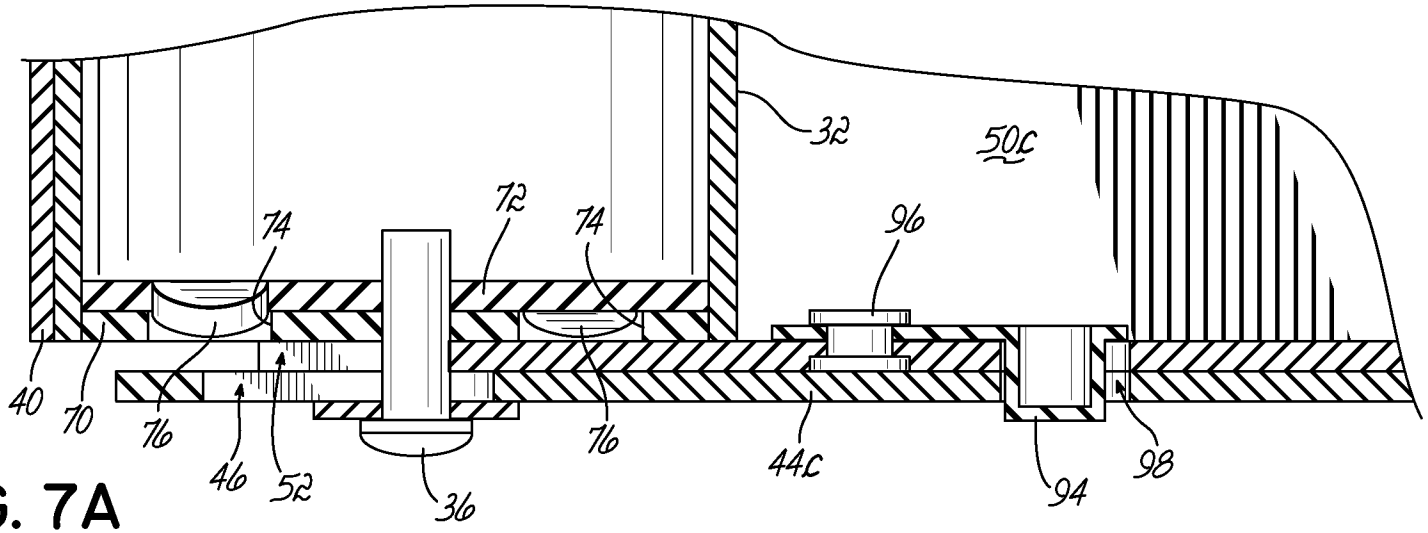
FIG. 7A is a partial, sectional view showing an alternative exemplary latching assembly in a latched position.
Figure 7B:
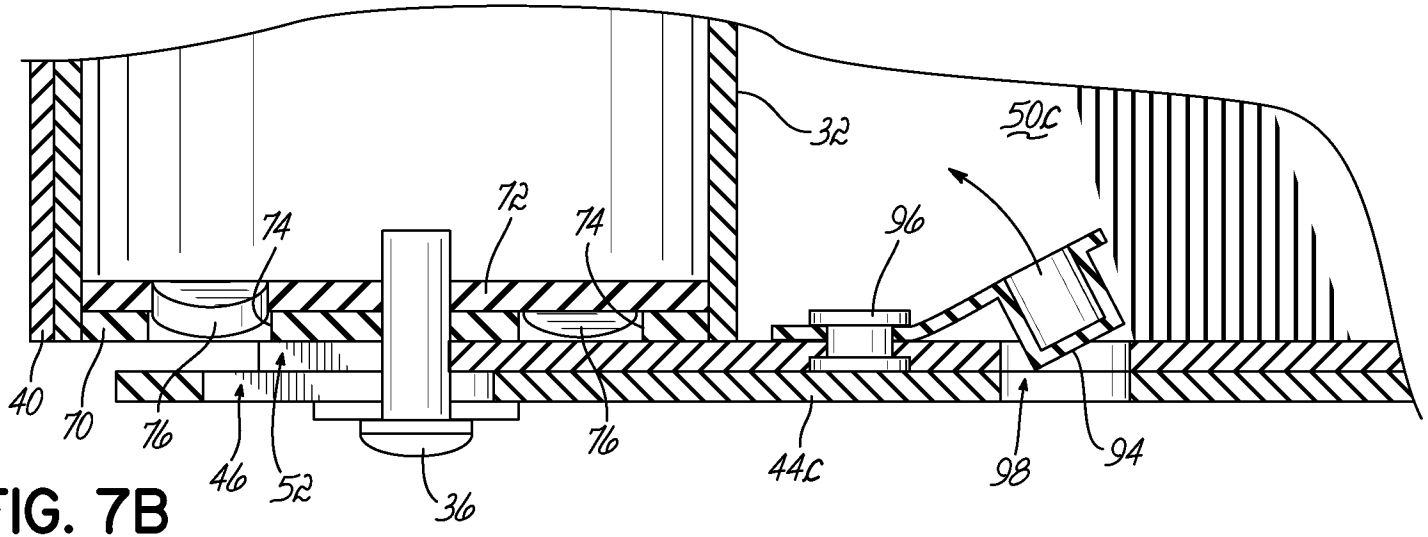
FIG. 7B is a partial, sectional view showing the alternative exemplary latching assembly of FIG. 7A moving to an unlatched position.

Alternative device 20*b* utilizes one exemplary latching mechanism as illustrated in FIG. 6. This latching mechanism uses a push button style latch. A hole is formed through first frame 44*b* and a flexible button latch 54 is formed into second frame section 50*b*. Slots 56 in frame 50*b* allow the button latch 54 to flex in and out of the hole in frame 44*b* to lock the frame sections together. An alternative, exemplary latching mechanism is illustrated in FIGS. 7A and 7B. In this embodiment, a flexible button latch 94 is attached by a fastener 96 on the inside of frame section 50*c*. Button latch 94 can be flexed in and out of holes 98, formed in frame sections 44*c*, 50*c*, as shown in FIG. 7B. Button latch 94 is normally disengaged from holes 98 to allow spring 60 to bias rollers 30, 32 to an outward position. For a belt change, rollers 30, 32 can be pushed inward until button latch 94 engages the aligned holes 98, as shown in FIG. 7A, to hold the rollers in the inward position. After the belt change, button 94 can be pushed out of holes 98, as shown in FIG. 7B, to allow the rollers to return to an outward-biased position.

Figure 2A:
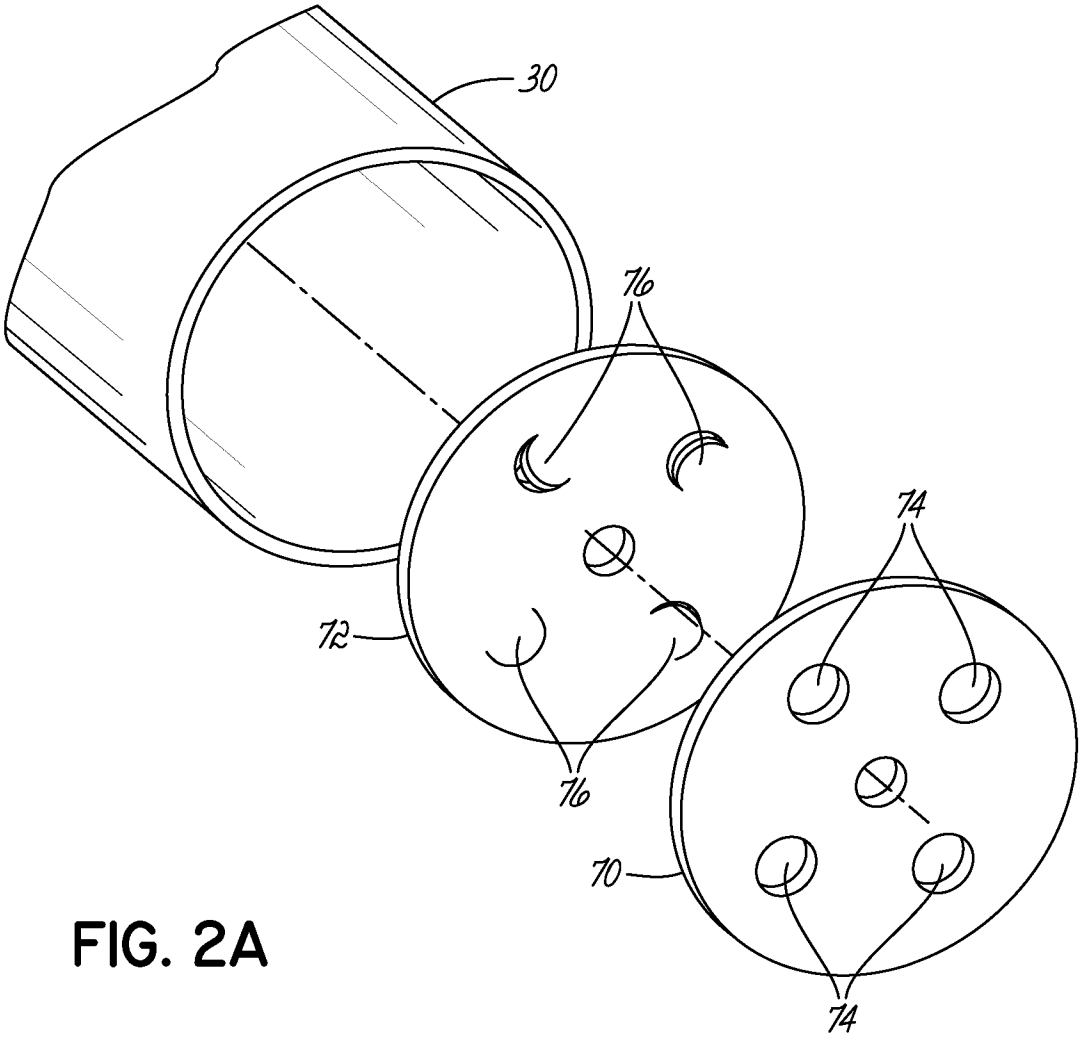
FIG. 2A is an exploded view of a roller end depicting an exemplary directional control scheme.

In the exemplary embodiment shown in FIGS. 1-4, belt 40 is rotated in a single direction by rollers 30, 32. Single direction rotation provides a more natural hand motion for a sanding operation, while continually changing the position of the belt to provide even wear of the belt and better sanding quality. A number of different mechanisms can be implemented in device 20 to control the direction of rotation of belt 40. In a first embodiment, shown in FIG. 2A, directional control is provided by a pair of disks 70, 72 turning against each other at the ends of one or both of the rollers 30, 32. The first disk 70 is fixed to frame section 50, and includes a plurality of radially-spaced holes 74 concentrically spaced about the rotational axis pin 34 or 36. The second disk 72 is fixed to the inner diameter of the roller 30 or 32, and includes a plurality of radially-spaced stops 76, also concentrically spaced about the rotational axis pin 34 or 36, and extending perpendicular to the planar face of the disk. Stops 76 are spaced to fit within holes 74 as the two disks rotate. FIG. 4 shows a stop disk 72 positioned at opposite ends of both rollers 30, 32, with a first disk 70 positioned over the stop disk. The contact between the stops 76 and the holes 74 limits the relative movement of the disks, permitting rotation of the disks and, thus, the rollers 30, 32, in only one direction.

Figure 8:
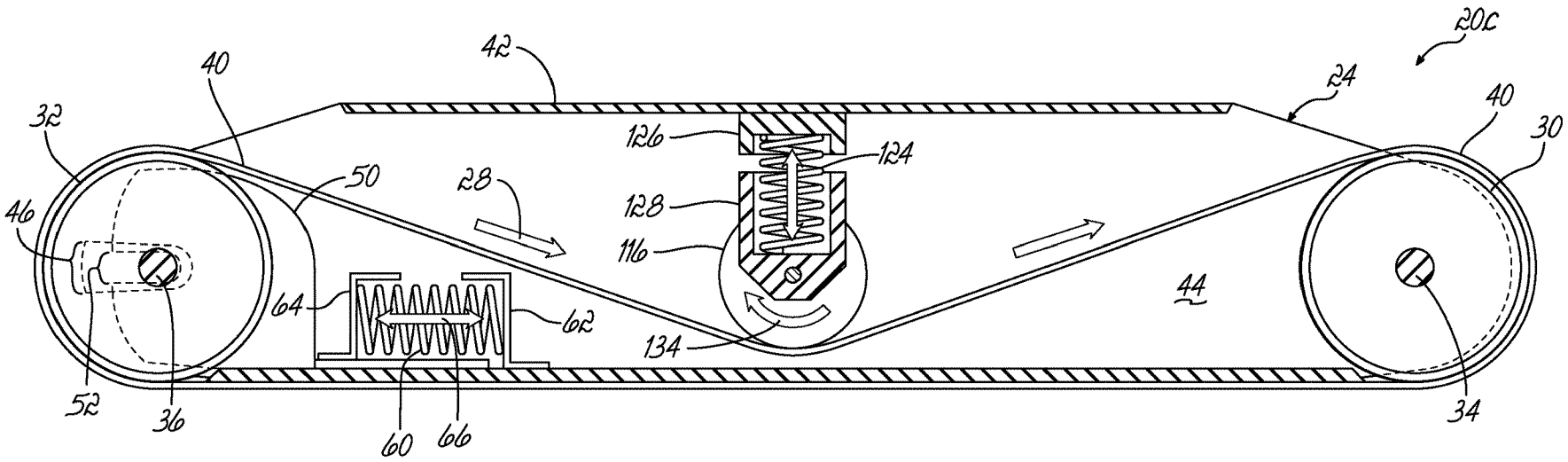
FIG. 8 is a side, partially sectional view of an exemplary embodiment of a directional control wheel for the sanding device.

Another exemplary form of directional control can be provided by using one-way or directional bearings in rollers 30, 32. The directional bearings may be mounted on the rotational axis of one or both rollers 30, 32 to allow roller rotation in only one direction. Additionally, the rotation direction of belt 40 can be controlled by a third wheel or axle device positioned in contact with the outer surface of the belt. FIG. 8 illustrates an exemplary embodiment of a sanding device 20*c*, in which directional control is provided by a third wheel 116. In this embodiment, the third wheel 116 contacts the outside of sanding belt 40 through pressure from a tensioning member 124. Tensioning member 124 extends between a first bracket 126 attached to cover 42, and a second bracket 128 attached to the axis of wheel 116. Wheel 116 is biased into contact with belt 40 by the force of the tensioning member 124 between the wheel and cover 42. Wheel 116 tensions belt 40 when cover 42 is closed and the tensioning member 124 is compressed. The rotational direction 134 of wheel 116 is opposite of the rotational direction 28 of belt 40. In device 20*c*, rollers 30, 32 are drawn closer together than in the previous embodiment 20, due to the pressure of the third wheel 116 on belt 40, enabling the device to have a shorter longitudinal length compared to device 20 for the same length sanding belt 40. Rollers 30, 32 are free spinning on the inner circumference of the belt 40, while the third wheel 116 provides directional control to the outside of the belt. In addition to the described methods, it is envisioned that numerous other methods and apparatus known in the art may be used for providing directional control of belt 40.

Figures 9, 9A:
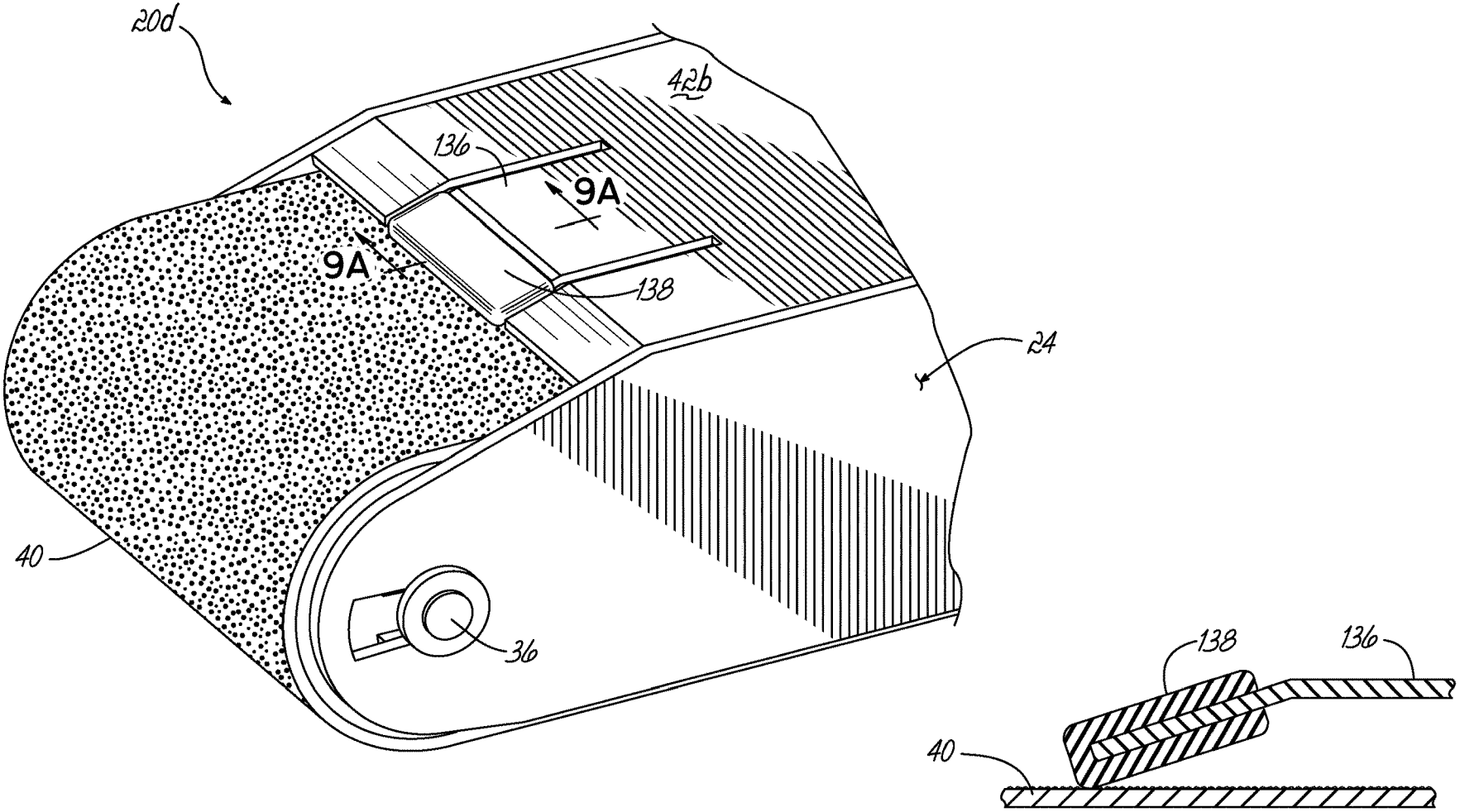
FIG. 9 is a partial, perspective view of an exemplary sanding device depicting a manual control.
FIG. 9A is a sectional view of the manual control taken along line 9A-9A of FIG. 9.

Additionally, instead of limiting rotation to one direction, the sanding device can include directional controls to allow unencumbered or unrestricted rotation in one direction, and limited rotation in the reverse direction. Allowing limited rotation in the reverse direction can reduce wear on the sanding belt during light sanding operations. The limited movement in the reverse direction can be accomplished using manual control. An exemplary sanding device 20*d* having a form of manual control is illustrated in FIGS. 9 and 9A. In device 20*d*, manual control is provided through a flexible tab 136 formed into cover 42*b*. Tab 136 can be flexed by a finger in a downward direction into contact with belt 40. As shown in FIG. 9A, a pad 138 may be provided on the end of tab 136, and secured by an interference or snap fit, to increase friction between the tab and belt 40. The friction created by contact between tab 136 and belt 40 controls the slippage of the belt. The pressure applied to tab 136 can be varied to slow or completely stop belt rotation, thereby enabling the user to control which section of the belt contacts the work piece, and providing an increased sense of control during use, as well as prolonging belt life.

Figure 5B:
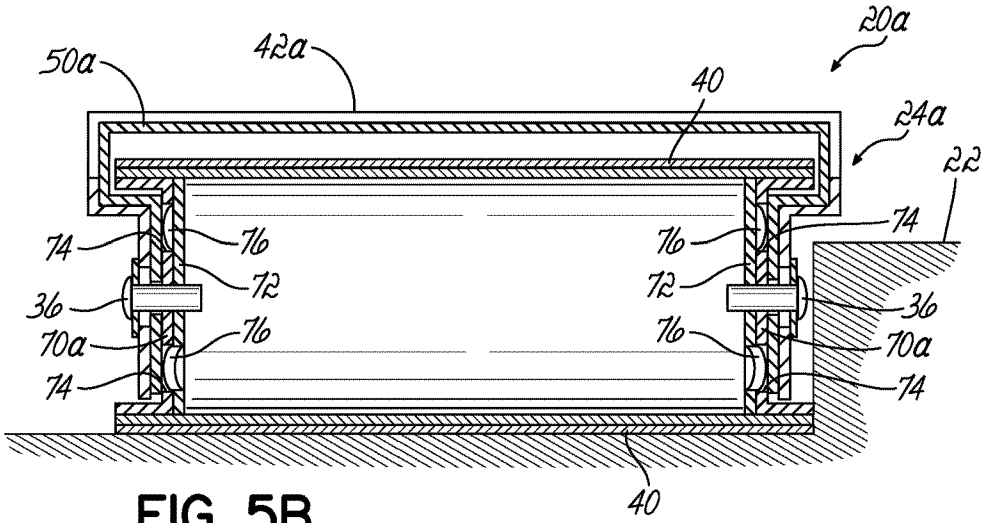
FIG. 5B is a cross-sectional view of the sanding device end shown in FIG. 5A, taken along line 5B-5B of FIG. 5A.
Figure 5A:
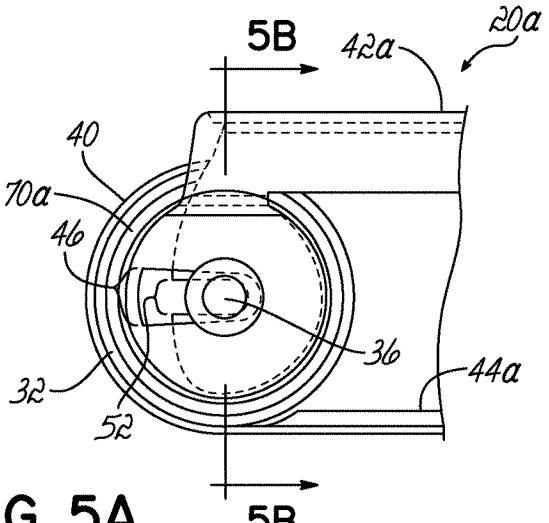
FIG. 5A is a partial, side view of an alternative embodiment of the sanding device, showing a roller mounted at one end of the device frame.
Figure 5C:
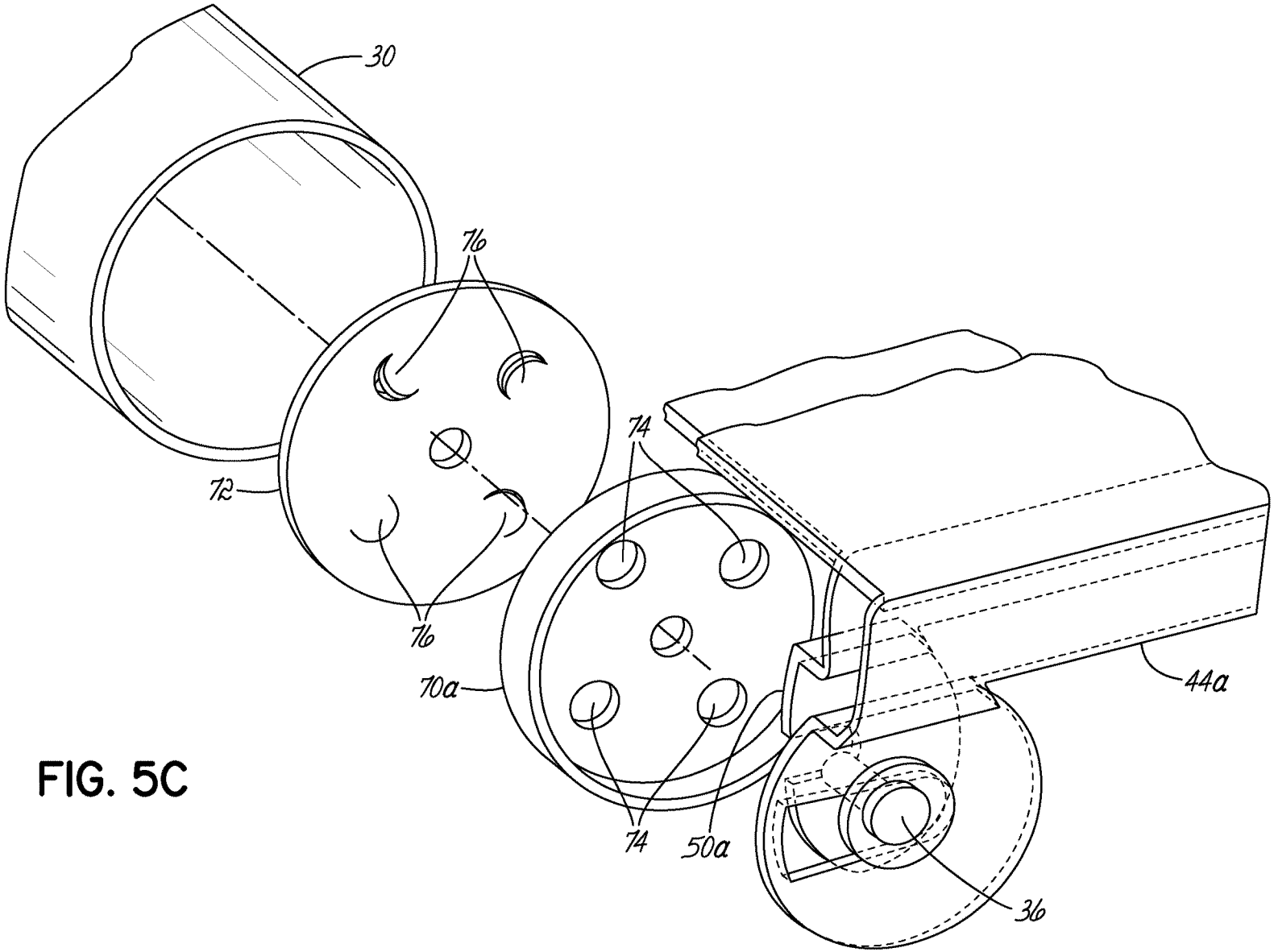
FIG. 5C is an exploded, partial end view of the roller of FIG. 5A, depicting an exemplary directional control scheme.

In an alternative embodiment, shown in FIGS. 5A and 5B, the sanding device can be designed, as indicated at 20*a*, so that the frame is the same width as the sanding belt. Altering the device frame, as indicated by frame 24*a*, enables the rollers 30, 32 to have a width that is less than at least part of the frame 24*a*, including sections 44*a* and 50*a*. The reduced width of the rollers 30, 32 and frame 24*a* relative to the belt 40, allows the sanding device to be maneuvered into a corner of a work piece 22, as shown, to enable sanding in a corner or up against a raised edge. FIG. 5C illustrates a directional control scheme similar to FIG. 2A, for the device embodiment shown in FIGS. 5A and 5B. As shown in FIGS. 5B and 5C, directional control can be provided for the reduced frame width, by a pair of disks 70*a*, 72 turning against each other at the ends of one or both rollers 30, 32. The first disk 70*a* which is positioned between frame section 50*a* and disk 72, includes a plurality of radially-spaced holes 74 concentrically spaced about the rotational axis pin 34 or 36. The second disk 72 includes a plurality of radially-spaced stops 76, also concentrically spaced about the rotational axis pin 34 or 36, and extending perpendicular to the planar face of the disk. Stops 76 are spaced to fit within holes 74 as the two disks rotate. As shown in FIG. 5B, the stop disk 72 is positioned at opposite ends of roller 32, with the first disk 70*a* positioned over the stop disk. The contact between the stops 76 and the holes 74 limits the relative movement of the disks, permitting rotation of the disks and, thus, the rollers, in only one direction.

Figure 10:
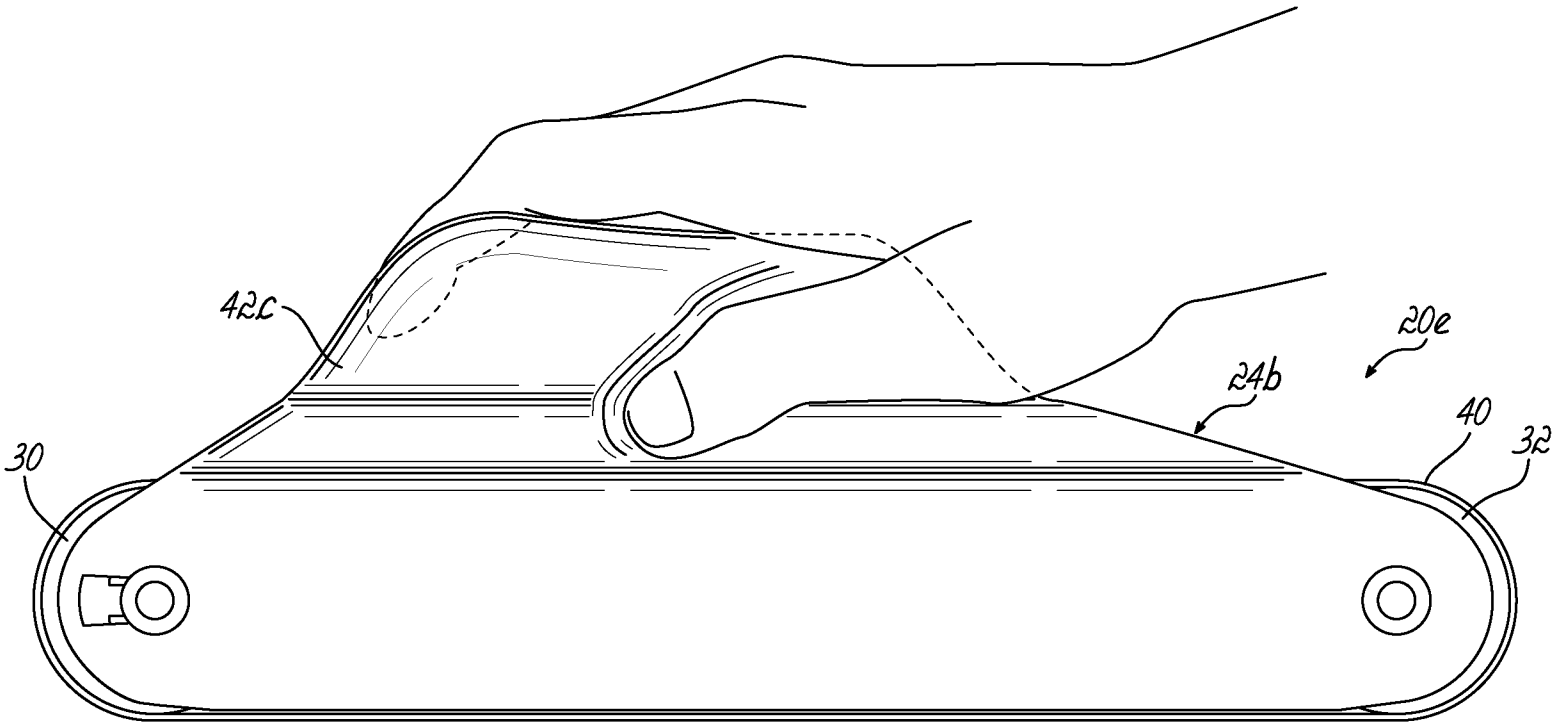
FIG. 10 is a side, diagrammatic view of an alternative embodiment of the sanding device depicting a hand positioned on the device and performing a sanding operation.

In other exemplary embodiments, the shape and/or structure of the device frame can be modified to incorporate additional features for the sanding device. For example, the shape of the device frame may be modified, as shown at 24*b* in FIG. 10, to form a more ergonomic hand grip for the device. Device 20*e*, as shown in this embodiment, can have a raised cover 42*c* and an asymmetric shape, with a thumb recession on one side and finger recessions on the other. With an asymmetric shape, the rotation direction of the belt is preferably reversible to prevent user fatigue from holding the device in the same manner. Alternatively, device 20*e* can have generic recessions on both sides of the cover 42*c* to allow the device to be turned around and used to sand in the opposite direction. In addition, it is envisioned that at least a portion of device 20*e* could be composed of a plastic material that is malleable when heated, to enable the device to be customized to an individual user's hand.

Figure 11:
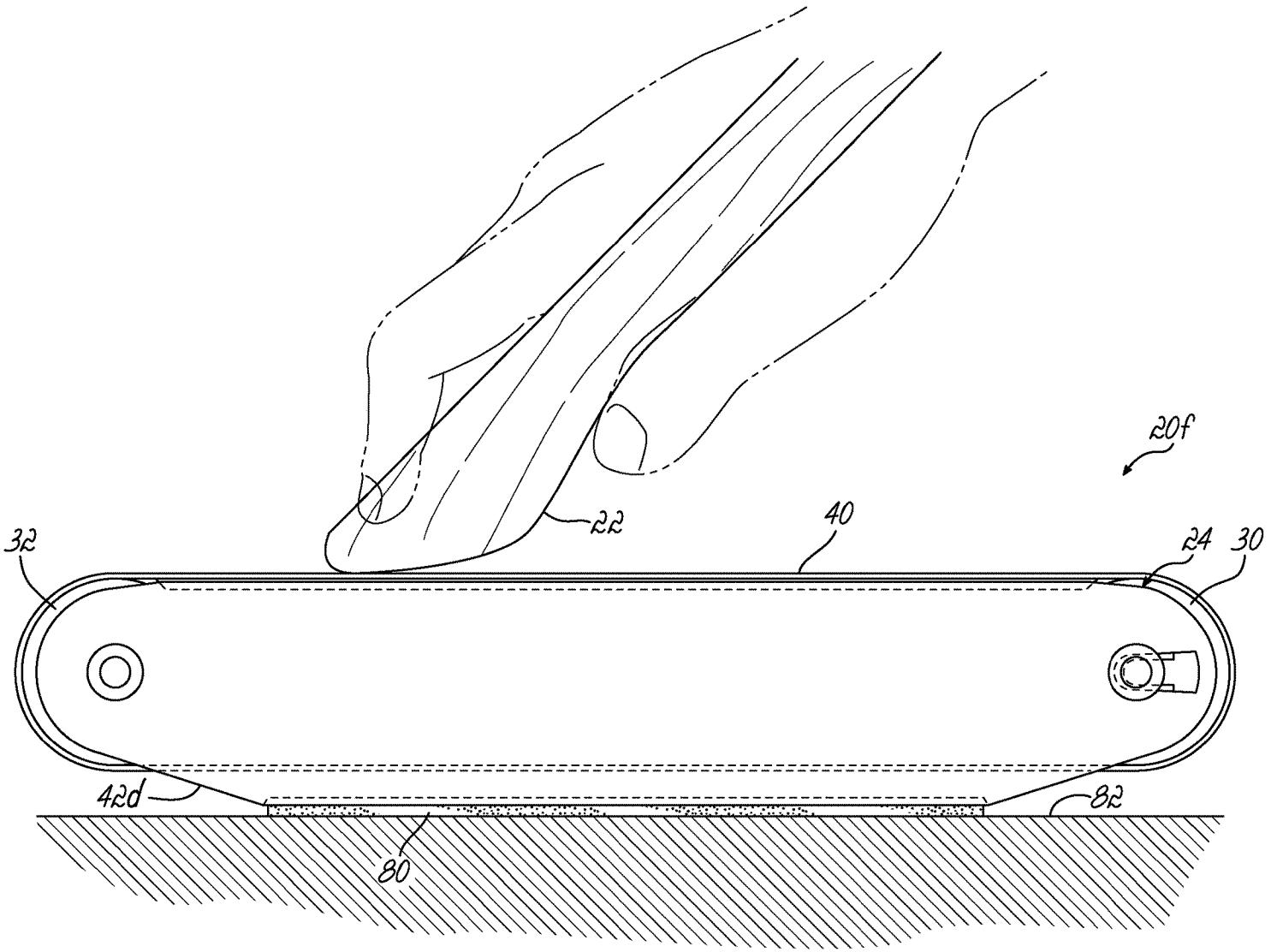
FIG. 11 is a side, diagrammatic view of an alternative embodiment of the sanding device depicting the device being used in a rotated orientation.

In another alternative embodiment, shown as device 20*f* in FIG. 11, cover 42*d* can have a flat surface and include a layer of anti-skid or tacky material 80 on the outside of the cover. The layer 80 could, for example, be composed of a thermoplastic polyurethane or silicone rubber. The device can then be flipped over and used in an upside-down position as a stationary sanding tool. The anti-skid layer 80 on cover 42*d* will hold the device in place on a flat surface, such as a work table 82. In this position, belt 40 can be advanced as desired, either manually or through contact with a work piece 22, to clear dust, and prevent excessive wear on any one section of the belt.

Figure 12:
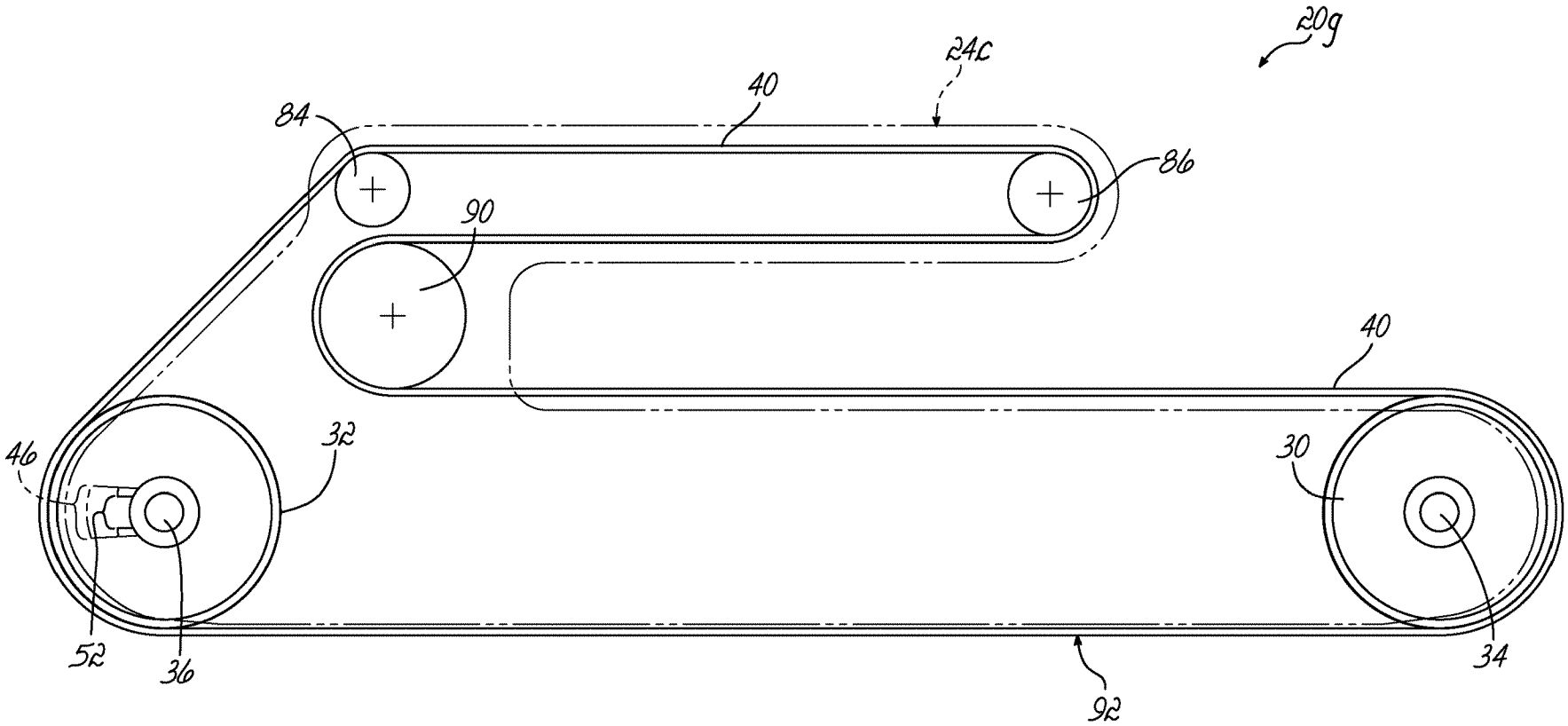
FIG. 12 is a side, diagrammatic view of an alternative, multiple roller embodiment of the sanding device with frame shown in phantom.

As mentioned above, belt 40 can have varying widths to accommodate a number of different types of projects. Additionally, belt 40 can have varying lengths, with the length of the device varying to accommodate the different belt lengths. As shown in FIG. 12, the sanding device can also be modified, as shown by device 20*g*, to include more than two rollers and, thereby, accommodate a longer length belt. Belt 40 can be trained over the additional rollers 84, 86, and 90, to remain taut within device 20*g*, while rotating through a planar sanding surface 92 along the bottom length of the device. Using a longer belt in this manner can extend the period of use between belt changes. To replace the belt 40, rollers 30, 32 can be compressed inwardly, as described above, to release the tension in the belt, and enable the belt to be slipped off of the multiple rollers and replaced. In embodiments having numerous rollers, the device frame may be modified, as indicated by 24*c*, to encompass the additional rollers while still providing a comfortable hand grip for operating the device.

Figure 13:
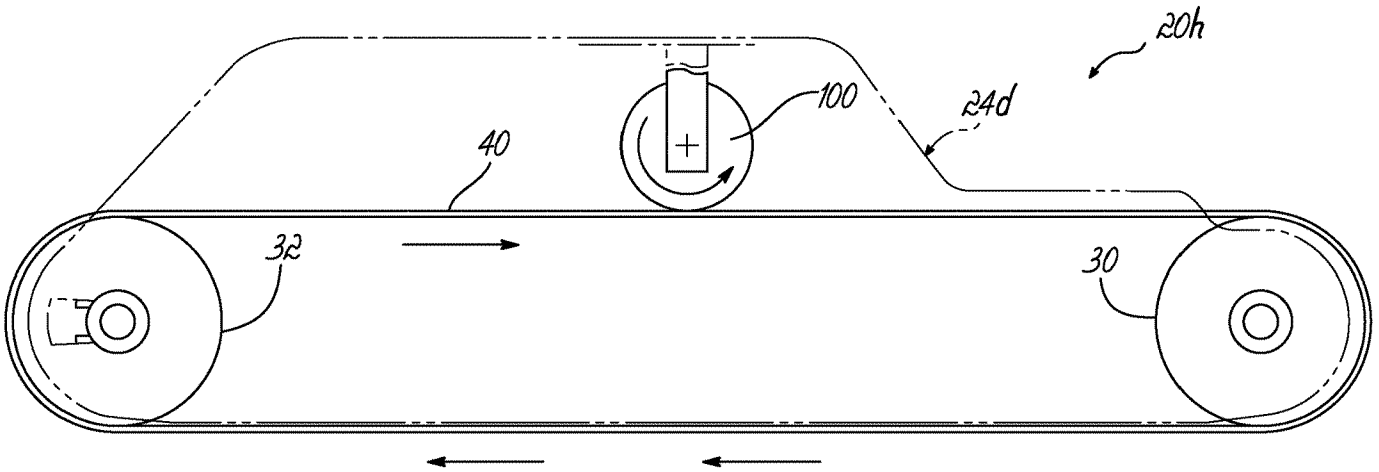
FIG. 13 is a side, diagrammatic view of a first, alternative, motorized embodiment of the sanding device with frame shown in phantom.
Figure 14:
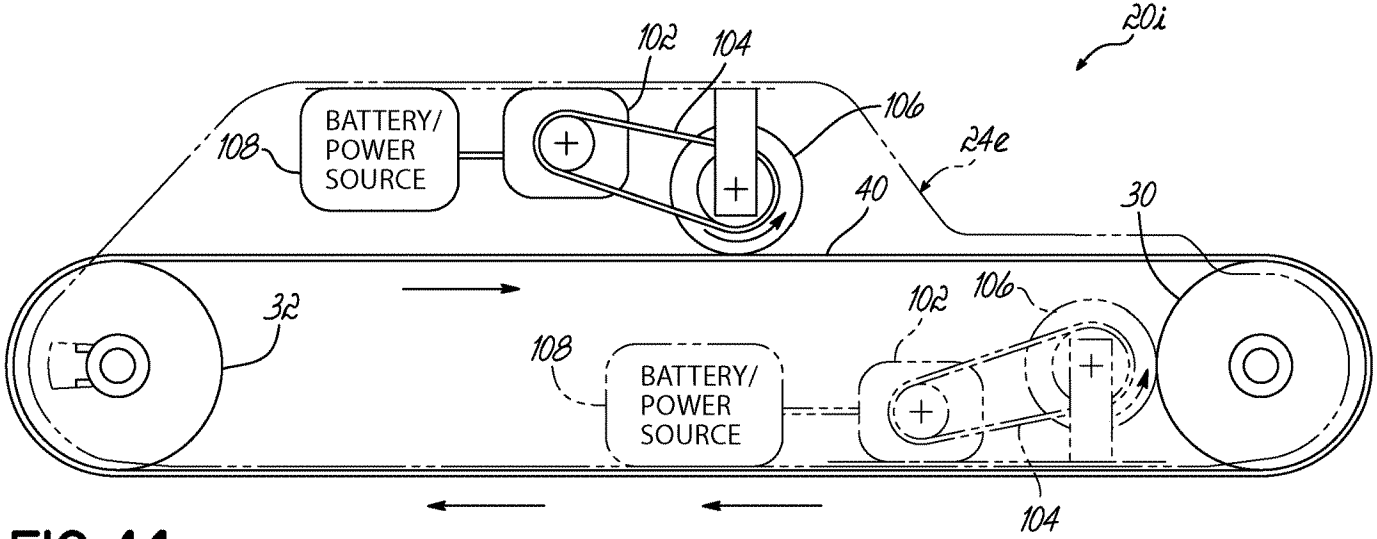
FIG. 14 is a side, diagrammatic view of a second, alternative, motorized embodiment of the sanding device with frame shown in phantom.

While the sanding device has been described above as being a manual sanding device in which the sanding belt is continuously rotated through frictional contact between the belt and work piece, the device can optionally also include a motor for powering the belt directly, or powering one or more of the belt rollers. As shown in FIG. 13, a modified sanding device 20*h* includes a motorized drive wheel 100 mounted in contact with belt 40 inside frame 24*d*. A motor mounted inside the wheel 100 can drive the wheel to rotate belt 40 through frictional contact between the belt and wheel. Alternatively, as shown in FIG. 14, one or more motorized drive wheels 106 can be provided within a modified device 20*i*, inside frame 24*e*, for providing direct drive to either belt 40, one or more rollers 30, 32, or directly to both the belt and rollers. One or more motors 102 could be mounted in frame 24*e* above belt 40 as shown. The motors 102 can rotate a drive belt 104 and wheel 106 in contact with the belt 40. Optionally, as shown in phantom, motors 102 may be connected via a drive belt 104 to one or both rollers 30, 32 (only a connection to roller 30 is shown) for providing a direct drive of one or both rollers. The motors 102 may be powered by batteries 108, or an alternative, internal or external power source.

Figure 15:
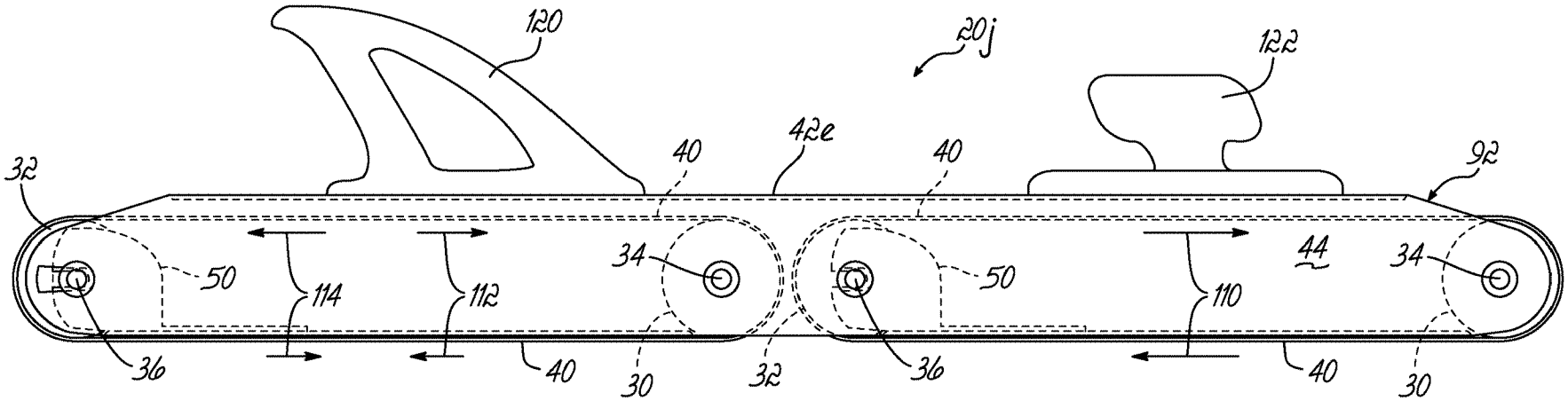
FIG. 15 is a side view of an alternative, multiple belt embodiment of the sanding device.

In another exemplary embodiment, the sanding device may be modified to include more than one sanding belt and roller pair unit. Each of the individual sanding belt units can be constructed as described above to enable the individual belts to be tensioned between the roller pairs, and each of the roller pairs retracted inward, as needed, to release and replace the belts. As shown in FIG. 15, in this embodiment of a device 20*j*, multiple sanding belts 40 may be rotated in the same direction, as indicated by the arrows 110, 112, to increase the effective length of a work piece that can be sanded at one time. Increasing the number of sanding units within the device provides for a longer planar sanding surface, while maintaining the same standard belt loop size as a single belt unit. Alternatively, the multiple sanding belts may be rotated in opposite directions, as indicated by arrows 110 and 114, using a directional control mechanism as described above. Rotating the two belts in opposing directions allows for bi-directional sanding. Using multiple sanding belts 40, as in exemplary device 20*j*, will allow for faster sanding of large work pieces. Also, the longer sanding surface 92 provided by multiple sanding units will be more effective at flattening the surface of a work piece, because the larger contact area will even out high and low spots. In this embodiment, cover 42*e* can be altered to include additional handles, such as a hand grip 120 and palm grip 122, similar to a woodworking plane. The device can also include one or more pads on cover 42*e* (not shown) to provide cushioning for the user's arms on the longer device.

Figure 16:
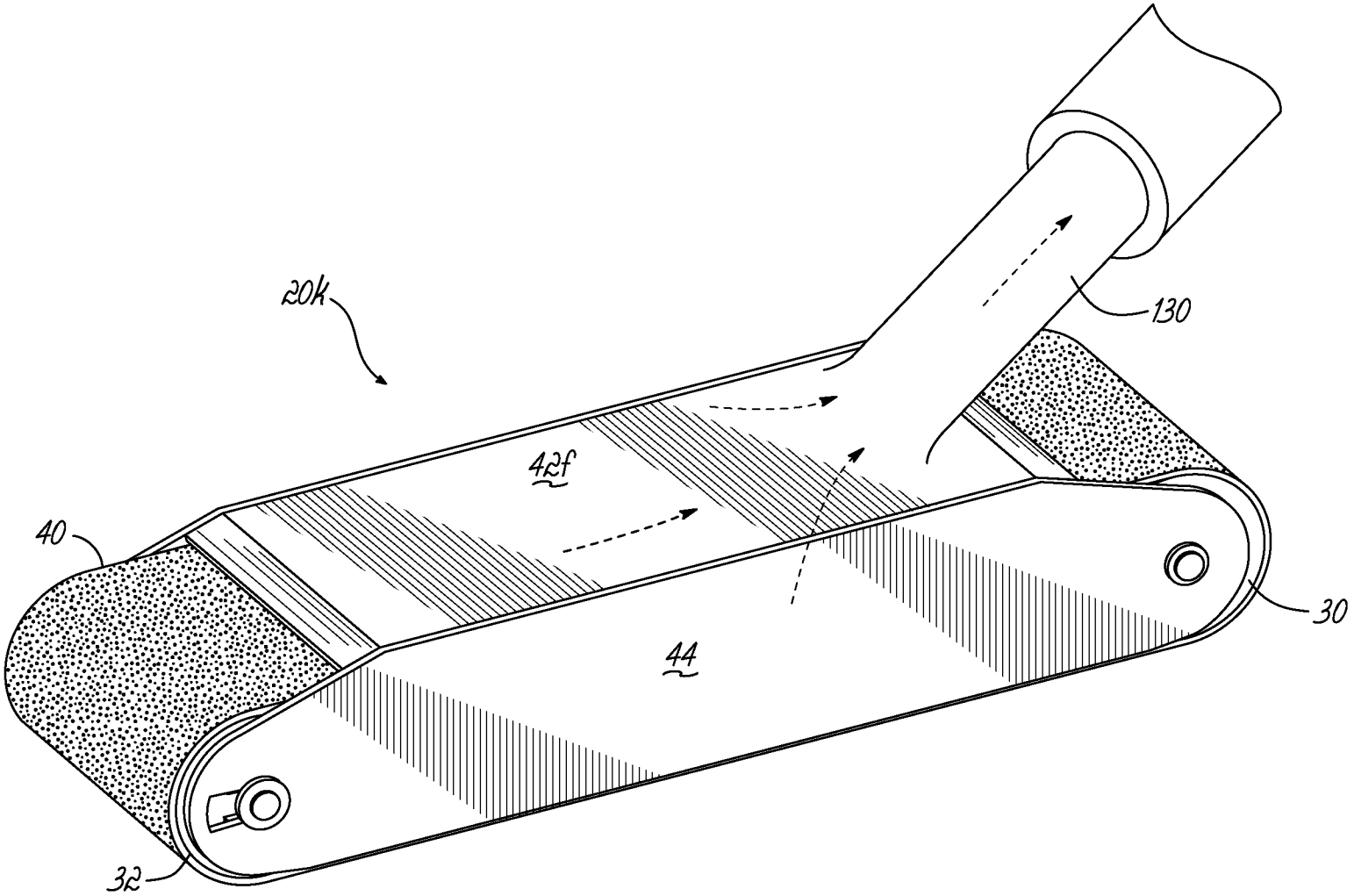
FIG. 16 is a perspective view of an alternative embodiment of the sanding device.

In yet another alternative embodiment, shown in FIG. 16, the sanding device can be modified, as shown in device 20*k*, to incorporate a vacuum attachment 130 for suctioning out dust produced during a sanding operation. Vacuum attachment 130 can connect to cover 42*f* at a position away from the hand grip so as to not interfere with use of the device. Vacuum attachment 130 can be connectable to a standard wet/dry vacuum system for removing dust from the sanding belt as the belt rotates beneath the cover. Alternatively, device 20*k* can incorporate a manual catcher bag or canister (not shown), and one or more vacuum ports beneath cover 42*f*, to accumulate the sanding dust and debris. The canister can be periodically emptied during a sanding operation to control the dust.

Figure 17:
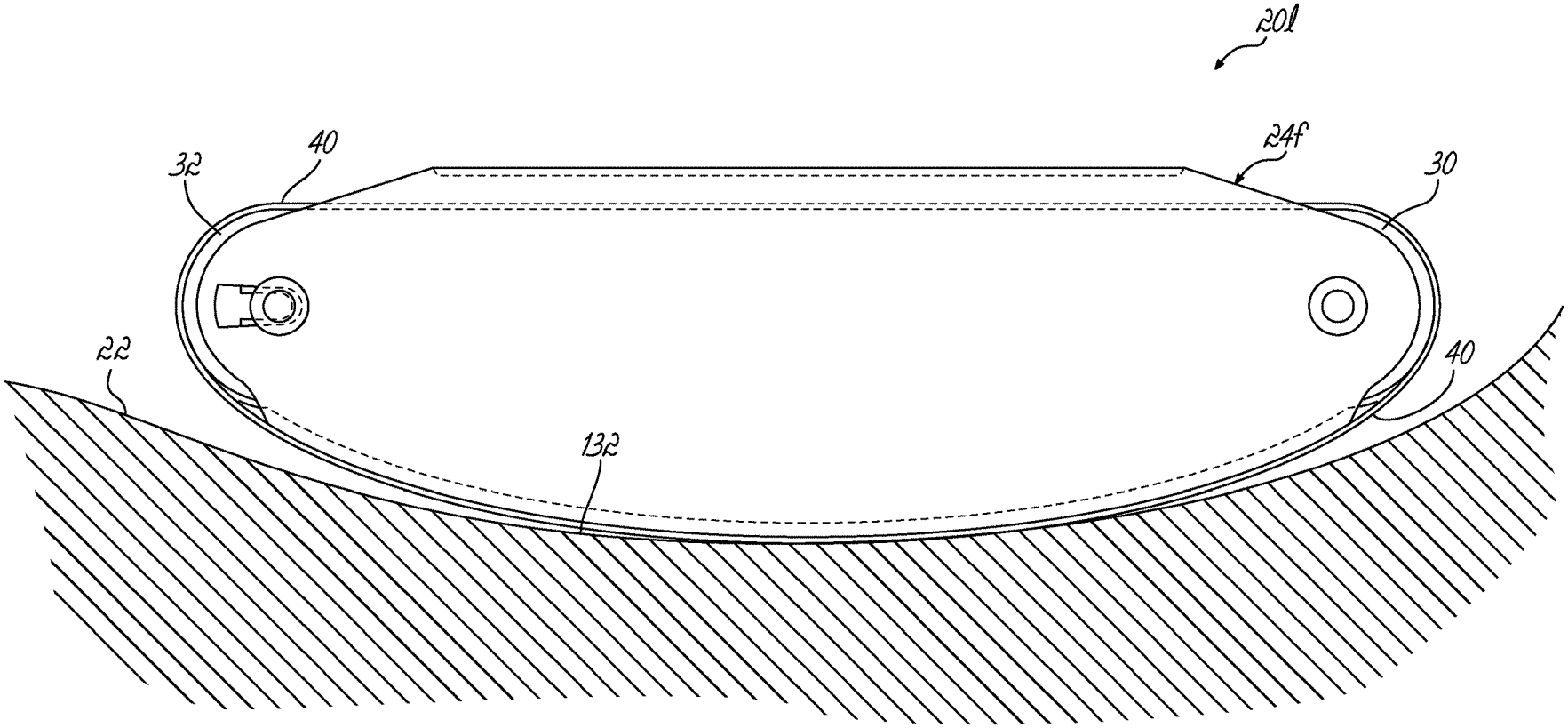
FIG. 17 is a side view of another alternative embodiment of the sanding device.

FIG. 17 depicts another alternative embodiment, identified as device 20*l*, in which the shape of the device frame is modified to provide a curved sanding surface 132, rather than the planar sanding surface 92. The curved surface 132 shown in FIG. 17 provides for easier sanding of curved work pieces. In addition to the convex sanding surface shown in FIG. 17, it is envisioned that frame 24*f* may also be modified to provide a concave sanding surface.

Figure 18:
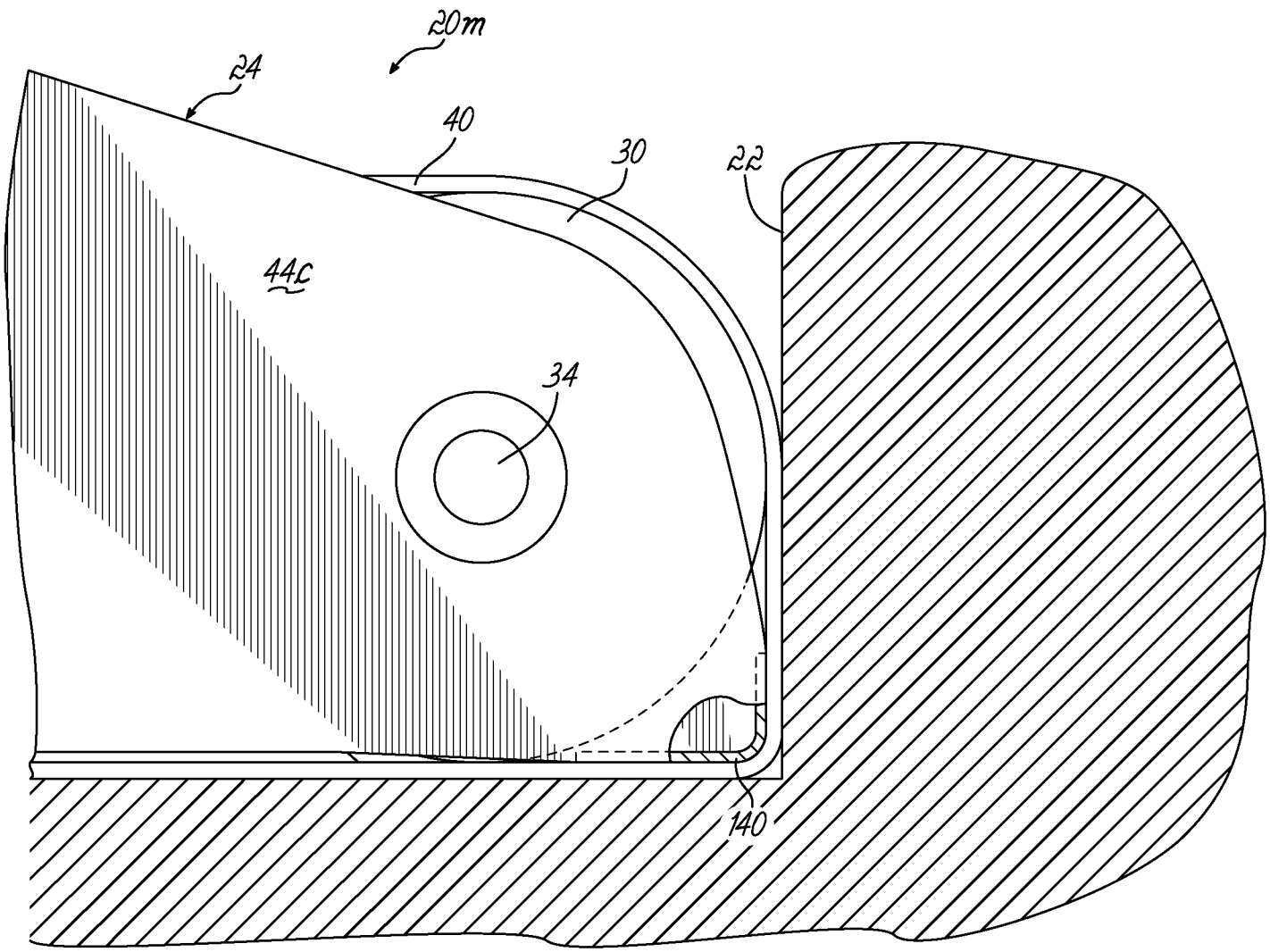
FIG. 18 is a partial, side view of an alternative embodiment of the sanding device, with a portion of the device frame broken away to show a sanding tip.

As shown in FIG. 18, in another alternative embodiment, identified as device 20*m*, the device is modified so that frame section 44*c* include a sanding tip 140 having a sharper radius than the radius of rollers 30, 32. The sharper radius can be achieved using a formed and rigid material, such as steel, positioned between one or both of the rollers 30, 32 and the belt 40. The tip 140 can extend between side members of modified frame section 44*c*. Tip 140 can be located so as to allow belt 40 to rotate about the tip during the continuous rotating motion. Sharpened tip 140 can be used to reach into corners, as shown, or other intricate areas of a work piece 22.

The present invention has been described in connection with several embodiments and some of those embodiments have been elaborated in substantial detail. However, the scope of the invention is not to be limited by these embodiments which are presented as exemplary and not exclusive. The scope of the invention being claimed is set forth by the following claims.

What is claimed is:

1. A hand-held sanding device for sanding a work piece, the device comprising:

a frame adapted for a manual grip and permitting application of a manual pulling force across a workpiece;

rollers coupled to the frame;

a sanding material provided within and coupled to the rollers and frame for movement with the frame when the rollers are not permitted to roll, and movement relative to the frame when the rollers are permitted to roll, the sanding material forming a sanding surface for the device in frictional contact with a workpiece, and creating a secondary pulling force on the sanding material relative to the frame by application of said manual pulling force; and a mechanism which permits rolling of the rollers and permits movement of the sanding material relative to the frame in a first direction in response to said secondary pulling force, and restricts rolling of the rollers and restricts movement of the sanding material relative to the frame in a direction opposite to the first direction.

2. The sanding device of claim 1, wherein the mechanism includes a manual control selectively restricting movement of the sanding material relative to the frame, such that the sanding material moves relative to the frame during some but not all strokes of a repetitive sanding operation.

3. The sanding device of claim 2, wherein the manual control comprises a finger-actuated tab, wherein the presence of finger pressure on the tab determines whether the sanding material moves relative to the frame through frictional contact between the sanding surface and the work piece.

4. The sanding device of claim 1, wherein the device further comprises a tensioning means in the frame for maintaining the sanding material in a taut condition.

5. The sanding device of claim 4, wherein the sanding material is shaped in a loop, and the sanding device further comprises rotating members for rotating the sanding material loop.

6. The sanding device of claim 5, wherein the sanding material is mounted around the rotating members for rotation with the members relative to the frame.

7. The sanding device of claim 6, wherein the sanding material rotates with the rotating members to change an area of contact between the sanding material and the work piece during the sanding operation.

8. The sanding device of claim 6, wherein the tensioning means further comprises a resilient member for biasing the rotating members in a spaced relationship, and wherein the sanding material is held in a taut condition about the rotating members by the resilient member.

9. The sanding device of claim 6, wherein the rotation of the sanding material is limited to a single direction.

10. The sanding device of claim 9, wherein one or more of the rotating members further comprise a mechanism for controlling the rotation direction of the sanding material.

11. The sanding device of claim 8, wherein the sanding material is removable from the frame.

12. The sanding device of claim 11, wherein the frame further comprises an apparatus for enabling the rotating members to move in an inward direction to release the sanding material from the frame.

13. A hand-held sanding device comprising:

a frame including a manual grip permitting application of a manual pulling force across a workpiece;

a plurality of rollers mounted within the frame, one or more of the rollers coupled to the frame via a mechanism which permits rotation of a roller in a first direction and restricts rotation of the roller in a second direction opposite the first direction;

a sanding belt trained over the rollers to rotate with the rollers during a sanding operation, and creating a secondary force on the sanding belt and rollers by application of said manual pulling force, the mechanism coupling the frame and rollers permitting said rotation of a roller in said first direction response to said secondary force; and a tensioning member for maintaining tension in the sanding belt as the belt rotates with the rollers, the tensioned belt forming a planar sanding surface for the device.

14. The sanding device of claim 13, wherein the plurality of rollers are a pair of rollers rotatably mounted in a spaced relationship within the frame.

15. The sanding device of claim 14, wherein the tensioning member further comprises a resilient member for biasing the roller pair into said spaced relationship, the resilient member being compressable to alter the spaced relationship of the roller pair to release the tension in the sanding belt.

16. The sanding device of claim 13, wherein the mechanism coupling the rollers to the frame prevents rotation of a roller in one direction, such that belt rotation is limited to a single direction.

17. The sanding device of claim 14, wherein the pair of rollers are primarily rotated in one direction.

18. The sanding device of claim 13, wherein the manual grip of the frame is molded to conform to the shape of a human hand.

19. The sanding device of claim 13, wherein the sanding belt is rotated about the plurality of rollers by application of the manual pulling force during contact between the planar sanding surface and a work piece.

20. The sanding device of claim 13, further comprising at least one motor for rotating the sanding belt.

21. The sanding device of claim 14, wherein the frame further comprises a cover pivotally attached to a side of the frame, the cover being pivotable relative to the belt to provide access to the belt.

22. The sanding device of claim 14, wherein the tensioning member is adjustable to retract the roller pair, the tension in the sanding belt being released as the roller pair retracts to enable the sanding belt to be removed from the device.

23. The sanding device of claim 14, wherein the mechanism coupled to one or more of the rollers further comprises a direction control mechanism for controlling the permitted rotation direction of the sanding belt.

24. The sanding device of claim 23, wherein the direction control mechanism comprises a pair of disks rotating together, a first disk having a plurality of radially spaced holes and a second disk having a plurality of radially spaced stops extending perpendicular to a planar face of the disk, the stops being spaced to fit the holes as the two disks rotate, the contact between the stops and the holes limiting rotation of the sanding belt.

* * * * *